US005742992A

United States Patent [19]

Kaempen

[11] Patent Number: 5,742,992

[45] Date of Patent: Apr. 28, 1998

[54] METHOD FOR MAKING COMPOSITE DOUBLE-WALL UNDERGROUND TANK STRUCTURE

[75] Inventor: Charles E. Kaempen, Orange, Calif.

[73] Assignee: Charles R. Kaempen, Alta Loma, Calif.

[21] Appl. No.: 606,604

[22] Filed: Feb. 26, 1996

Related U.S. Application Data

[62] Division of Ser. No. 271,362, Jul. 6, 1994, Pat. No. 5,590, 803.

[51] Int. Cl.[6] ..... B21D 39/00

[52] U.S. Cl. ..... 29/455.1

[58] Field of Search ..... 29/455.1, 897; 220/461, 565

[56] References Cited

U.S. PATENT DOCUMENTS

| | | | |
|---|---|---|---|
| 2,533,041 | 12/1950 | Plummer | 220/565 |
| 4,927,050 | 5/1990 | Palazzo | 29/455.1 |
| 5,065,890 | 11/1991 | Greenbaum | 220/461 |
| 5,152,859 | 10/1992 | Sharp | 29/455.1 |
| 5,259,895 | 11/1993 | Sharp | 29/455.1 |
| 5,351,847 | 10/1994 | Greenbaum | 220/461 |

*Primary Examiner*—David P. Bryant
*Attorney, Agent, or Firm*—Phillips, Moore, Lempio & Finley

[57] ABSTRACT

A composite double-wall underground tank comprises an internal rotatable metal mandrel tank frame structure surmounted by two individual concentric corrugated cylindrical nonmetallic pressure vessels having hemispherical ends. The metal tank frame structure provides the buckling resistance and compression strength to resist soil loads when the tank is buried. The pressure vessels are made of identical materials and include an internal primary container enclosed by an external secondary container of equal tensile strength and corrosion-resistance. The composite double-wall underground tank is a substantial improvement over conventional steel and fiberglass tanks, and provides a more reliable method of protecting the environment by preventing the release of contaminating hazardous liquids stored in the tank. Each of the two pressure vessels is made from a multiple ply composite laminate having a unique arrangement of fabrics containing filament reinforcements impregnated with a thermosetting polymeric matrix. The hemispherical ends have sealable axle access openings. The top tank fitting outlets include non-corrugated portions of the cylindrical laminate structures bonded together and sandwiched between bolted metal plates that are structurally connected to the tank frame and sealed with an overlapping laminate structure.

2 Claims, 9 Drawing Sheets

$I = 0.0362$ in.$^4$
Area = 0.4576 In.$^2$
U.L. Subject 1316 Tank Frame Rib $I = 0.0158$ in.$^4$
Area = 3.00 In.$^2$
U.L. Subject 58 Steel Tank Shell

METHOD FOR MAKING COMPOSITE DOUBLE-WALL UNDERGROUND TANK STRUCTURE

This a division of Ser. No. 08/271,363, filed on Jul. 6, 1994, now U.S. Pat. No. 5,590,803.

TECHNICAL FIELD

This invention generally relates to a double-wall corrugated composite laminate structure fabricated on an integral non-removable mandrel and more particularly to a corrosion-resistant nonmetallic underground fuel storage tank having a secondary container and an accessible annulus that can be monitored to provide warning of a leaking tank to prevent release of hazardous liquids that can damage the environment and water supplies.

BACKGROUND ART

Specifications for conventional underground storage tanks, including those incorporating secondary containment, are identified in the Flammable and Combustible Liquids Code published by the National Fire Protection Association and referred to as ANSI/NFPA 30, an American National Standard. The principal authority for establishing and publishing these tank specifications is Underwriters Laboratories Inc. Until 1964 nearly all underground storage tanks were made of steel and Underwriters Laboratories Inc. originally published only one specification for underground storage tanks: "Standard for Steel Underground Tanks for Flammable and Combustible Liquids, UL 58". On Feb. 2, 1966 a revision of Subject 58 was prepared by Underwriters Laboratories, Inc. to establish performance standards for "nonmetallic" glass-reinforced plastic underground storage tanks. A single wall underground tank meeting those standards, "Nonmetallic Underground Tank for Petroleum Products Only," was identified by Underwriters Laboratories, Inc. on Jul. 7, 1973 under UL File MH 8781. Specifications for making this single wall underground tank are described in Example III of U.S. Pat. No. 3,851,786, issued Dec. 3, 1974.

The 1966 Subject 58 has undergone numerous revisions. In 1977, "Subject 1316" entitled "Standard for Glass-Fiber Reinforced Plastic Underground Storage Tanks for Petroleum Products, UL 1316" was introduced, followed most recently with a revision in 1991 that included the chemical resistance and physical strength performance requirements of a double-wall non-metallic underground storage tank. That tank provides an outer secondary containment capability that prevents a release of the tank contents in the event the inner primary container develops a leak.

When it was recognized that destruction of fresh water supplies and serious damage to the environment resulted from the corrosion of steel underground storage tanks, the U.S. Environmental Protection Agency established corrosion resistance criteria for those tanks. To meet the EPA criteria the NFPA 30 code was modified to include a "Provision for Internal Corrosion," followed by an Underwriters Laboratories Inc. publication dated Nov. 22, 1989 citing another Standard for Safety titled "External Corrosion Protection Systems for Steel Underground Storage Tanks, UL 1746". This standard was revised on Jul. 27, 1993.

Conventional double wall underground storage tanks approved for use in the United States comprise secondary containment in compliance with Underwriters Laboratories, Inc. standards. Steel tanks and nonmetallic tanks having a secondary containment belong to the UL 1746 and 1316 categories, respectively.

UL 1746 type tanks having secondary containment usually consist of a plain steel "Subject 58" tank enclosed by a separate fiberglass shell made from a mixture of chopped-strand fiberglass and polyester resin. The UL 1746 tanks generally are not required to meet the same strength or chemical resistance standards as the relatively new UL 1316 type tanks that have a secondary containment capability. Since the inner and outer containers of a double wall UL 1746 tank do not need to resist the same internal test pressure as that required by UL 1316 tanks, they are generally constructed with flat ends rather than domed ends.

Underwriters Laboratories, Inc. has designated six classes of double wall "Subject 1316" type tanks having secondary containment. Three of the classes belong to the designation category referred to as "Type I" secondary containment tanks. Those tanks have an outer shell or cover that does not completely enclose the primary container. The other three classes belong to a second designation category referred to as "Type II" secondary containment tanks. The "Type II" UL 1316 tanks have an outer secondary container that completely encloses the primary container. UL designates the fuels that may be stored in either a Type I or a Type II UL 1316 tank having secondary containment dependent upon the chemical resistance of the tank's primary container. UL 1316 double wall tanks having the least chemical resistance belong to either Class 12 (Type I) or Class 15 (Type II) and are approved for storage of petroleum products only. UL 1316 double wall tanks having the most chemical resistance belong to either Class 14 (Type I) or Class 16 (Type II) and are tested and approved for storage of all petroleum products, as well as all alcohols and alcohol-gasoline mixtures.

The underground storage tanks that comply with Subject 1316 Class 16 (Type II) meet the highest strength and corrosion resistance performance standard established by Underwriters Laboratories, Inc. for the underground storage of flammable and combustible liquids. The primary container (inner wall tank), complying with Subject UL 1316 Class 16 Type II underground tank requirements, must be able to resist 25 psi pressure while the outer secondary tank is pressurized to at least 15 psi. The tank must be able to withstand a compression load produced by 11.75 in. Hg vacuum.

The conventional composite storage tanks of the prior art do not meet the 1993 standards of UL 1316 Class 16 (Type II) tanks. For example, the tank described in U.S. Pat. Nos. 3,677,432, and 3,851,786 does not disclose a double wall underground tank composition nor a method of making a composite double wall underground tank that will comply with the new 1993 standards. The double wall structure shown in FIG. 20 of U.S. Pat. No. 3,851,786 is intended to increase the overall section modulus and beam strength of the formed composite structure, rather than provide a secondary container as a back up in the event the inner primary tank leaks. That construction does not illustrate how such a composite structure can be adapted to provide underground tanks having secondary containers with provisions for annulus access of leak detection sensors and pressure-resistant tank outlets. Example III of U.S. Pat. No. 3,851,786 details the construction of a single wall underground tank that complied with 1973 UL test requirements established for nonmetallic underground tanks used only for the storage of petroleum products. The conventional laminate construction used to fabricate the single wall underground tank described in Example III of U.S. Pat. No. 3,851,786 does not meet the chemical resistance requirements outlined in the revised (1987) UL Subject 1316 for nonmetallic underground tanks used to store alcohol and petroleum products.

The prior art does not disclose a method for making a double-wall composite tank laminate structure having a wall thickness of only 0.12 inches (3 mm), that is able to pass the extensive series of current UL 1316, Class 16, Type II physical and chemical resistance tests. As is well known, the laminate thickness is a principal factor in determining the double-wall tank manufacturing cost and thus the ability to reduce thickness and yet maintain chemical and physical resistance is desirable.

All other conventional double-wall underground tanks currently listed under UL 1316 for storage of alcohol, gasohol and petroleum products are dome-ended cylinders made from a mixture of chopped strand fiberglass and a thermosetting polyester resin. In order to comply with NFPA 30, the Flammable and Combustible Liquids Code of the National Fire Protection Association, those prior art all-fiberglass underground tanks must meet the structural and corrosion resistant requirements outlined in UL 1316 and are tested to demonstrate an ability to resist an internal pressure of 25 psi (172 Pa) and a compression load equal to that produced by a negative pressure (vacuum) of –6 psi (–41 Pa) . Unlike the flat-ended UL 58 steel underground storage tanks that can not safely resist a test pressure exceeding 5 psi, all approved nonmetallic underground tanks must meet the pressure strength requirement of 25 psi with a factor of safety of 5. For that reason, all large diameter UL 1316 underground tanks must be fabricated as pressure vessels having hemispherical tank ends.

Prior art UL 1316 type double-wall all-fiberglass underground tanks that for the past 30 years have been adopted as an industry standard are still made from two chopped-strand fiberglass tank half-shells that are joined at the tank mid-section with resin-impregnated fiberglass cloth that overlaps the abutting edges of each tank half-shell. Each of those half-shells are made on a two-piece collapsible or removable steel mandrel upon which a mixture of chopped fiberglass and polyester resin is applied. The removable mandrel upon which each tank half-shell is made is shaped to form the domed end as well as half of the tank's cylinder. In some cases, the tank half-shell mandrel is supported at one end by a powered axle that acts as a rotating cantilever beam.

A conventional method for making a double-wall fiberglass tank half-shell involves the steps of placing a resin-release agent upon a half-shell mandrel surface, applying a mixture of polyester resin and chopped strand fiberglass upon the tank half-shell mandrel to make a tank inner wall structure, placing fiberglass rib formers on the half-shell inner wall, spraying a thin coat of resin-wet chopped strand fiberglass upon the rib formers, curing the half-shell inner wall material, perforating the sides of each fiberglass rib at several locations, placing a resin-release annulus-forming film on the inner wall tank head and a cylindrical portion of the tank inner wall between (but not on) each of the fiberglass ribs, and spraying a mixture of polyester resin and chopped strand fiberglass on the inner wall tank heads and the ribbed inner wall cylindrical portion to provide the double-wall tank half-shell with a secondary containment capability. The tank half-shell is then removed from the mandrel, placed on a cart and moved to a cut-off saw that precisely trims the shell so its edges can be matched with those of a second tank half-shell to which it is permanently bonded by an overlapping strip of resin-wet fiberglass cloth.

Conventional UL 1316 double-wall nonmetallic underground tank structures made from chopped strand fiberglass and a thermosetting resin possess a low tensile modulus and consequently are inherently flexible structures that will ovalize, change shape and possibly fracture unless they are carefully installed in and surrounded by pea gravel, crushed rock or other highly compacted soil. It is known in the art that each chopped strand of fiberglass material contains hundreds of short dry glass filaments that are tightly glued together by a starch binder to enable the strand of continuous glass filaments to be cut by the rotating razor blades of a strand-dispensing chopper gun. It is also well known in the art that the polyester resin mixed with the chopped strands of fiberglass does not completely dissolve the starch binder. For this reason the chopped strand fiberglass material used to make prior art underground tank structures contains millions of tiny dry-filament bundles surrounded by polyester resin. These dry filament bundles behave as microfractures in the resin matrix that reduce the tensile modulus of the fiberglass tank material. The use of dry sand in the construction of conventional chopped-strand fiberglass tanks provides another source of micro fractures and structural strength uncertainty. For this reason the resin-coated chopped strand fiberglass material comprising prior art double-wall nonmetallic underground storage tanks fails to provide the long term reliable leak-proof corrosion-resistant structural material desired by users of underground fuel storage tanks.

Conventional procedures used to make double-wall fiberglass underground tanks employ expensive and troublesome removable mandrels that require special care in their use and storage, as well as frequent maintenance and repair. The rate of tank production depends upon the availability of the removable tank mandrels. For this reason conventional fiberglass tank half-shells must be removed from the tank mandrel as quickly as possible. The tank half-shell removal time, however, is a function of the shell material cure time. Unfortunately, due to the presence of a wide variety of production variables, the material cure time of prior art fiberglass tank half-shells becomes extremely difficult to accurately predict or control. For example, the fabrication of conventional fiberglass tank half-shells greatly depends upon the skill, temperament and fatigue of the person responsible for controlling the quantity, ratios and placement of the chopped strand fiberglass and resin materials. Furthermore, the complexity of computer-controlled mandrel and carriage equipment used to make conventional fiberglass tank half shells is a cause of frequent production interruptions. The daily changes in ambient temperature and humidity require concomitant changes in the proportions of promoter and catalyst added to the polyester resin matrix used to make conventional fiberglass tank half-shells. The use of electrical heaters to accelerate the cure and hardening of the polyester resin used to make prior art fiberglass tank half-shells also requires special care to prevent the resin matrix from becoming too hot or igniting and burning. The manufacture of conventional fiberglass tank half-shells requires that the weight consumption of each of the materials as well as the thickness of the tank half-shell head, dome and ribs be continually measured and recorded to provide the necessary quality control. Mandrels used to make conventional fiberglass tank half-shells must be continually rotated until the chopped strand fiberglass material cures thereby preventing the wet tank half-shell material from sliding off the mandrel onto the floor. If, due to the pressure of time and production goals, a conventional fiberglass tank half-shell is removed from the mandrel too soon, it will ovalize and become out of round, making it difficult to trim and match with another fiberglass tank half-shell. The polyester resins used to manufacture most conventional fiberglass underground tanks are isophthalic polyester resins that do not contain a styrene suppressant additive. Since these polyester resins usually contain a weight percent of 40 to 50% of styrene monomer the manufacture of prior art all-fiberglass tank requires the use of expensive equipment to control the air pollution that results from the requisite spraying operations. The safe disposal and handling of the substantial quantity of flammable scrap materials resulting from fiberglass overspray and such operations as sawing, trimming, and flushing resin transfer lines, are additional concerns associated with the conventional production methods and apparatus used to make the conventional double-wall nonmetallic underground storage tanks in compliance with UL 1316 standards.

SUMMARY OF THE INVENTION

The present invention overcomes the foregoing problems of the prior art by providing a composite double-wall underground tank comprising an internal rotatable metal mandrel tank frame structure surmounted by two individual concentric corrugated cylindrical nonmetallic pressure vessels having hemispherical ends. The metal tank frame structure provides the buckling resistance and compression strength to resist soil loads when the tank is buried. The pressure vessels are made of identical materials and include an internal primary container enclosed by an external secondary container of equal tensile strength and corrosion-resistance. The composite double-wall underground tank is a substantial improvement over conventional steel and fiberglass tanks, and provides a more reliable method of protecting the environment by preventing the release of contaminating hazardous liquids stored in the tank. Each of the two pressure vessels is made from a multiple ply composite laminate having a unique arrangement of fabrics containing filament reinforcements impregnated with a thermosetting polymeric matrix. The hemispherical ends have sealable axle access openings. The top tank fitting outlets include non-corrugated portions of the cylindrical laminate structures bonded together and sandwiched between bolted metal plates that are structurally connected to the tank frame and sealed with an overlapping laminate structure. The annular space between the vessels includes a sump and annulus access conduit provided by a unique configuration of the lower portion of an outer vessel hemispherical composite laminate end structure. A preferred embodiment complies with the requirements of Type II Secondary Containment Nonmetallic Underground Tank for Petroleum Products, Alcohols and Alcohol-Gasoline Mixtures 360 Circumferential Degrees established by Underwriters Laboratories, Inc. and published as U.L. Subject 1316 "Glass Fiber-Reinforced Plastic Underground Storage Tanks for Petroleum Products". The method and apparatus for making the preferred embodiment of the invention comprise the procedures submitted by the inventor to Underwriters Laboratories, Inc. as part of UL file MH8781 published Sep. 30, 1993.

A principal aspect of the invention herein disclosed is the specific arrangement and selection of the fabrics and the thermosetting resin used to make the multiple-ply corrugated laminate structure of each of the concentric tank shells to provide a UL 1316 type nonmetallic underground storage tank having secondary containment. Each of the tank shell laminate structures comprising the subject invention is able to retain in excess of 50% of its original flexural strength after a 270 day immersion in the liquid chemicals outlined in the UL Subject 1316 specification, as well as safely resist an internal aerostatic tank pressure (in pounds per square inch) that equals the number 200 divided by the tank diameter in feet (25 psi for an 8 ft. dia. tank).

Another aspect of the present invention is a hemispherical composite laminate tank end structure having sealable axle access holes. The holes provide means for the tank frame support axles of the tank turning unit to be connected to the metal tank frame structure.

Yet another aspect of the present invention is a double-wall tank outlet sealing structure comprising concentric tank shell non-corrugated laminates that are intimately bonded to each other and to each of the metal tank outlet fitting plates welded to the metal tank frame.

Yet a further aspect of this invention is a hemispherical composite outer tank end shell structure configured to provide a composite double wall underground tank with a bottom liquid-trapping tank annulus sump and a curved annulus sump access conduit that enables a flexible dip stick or leak detecting sensor system to monitor the tank's containment integrity.

Another aspect of this invention is a composite head-to-shell anchor ring structure that is fabricated upon longitudinally oriented continuous filament strands that overlap the edge of each hemispherical tank end so as to permanently attach to the tank end the longitudinal continuous filament strands comprising the cylindrical tank shell laminate.

BRIEF DESCRIPTION OF DRAWINGS

Other objects and advantages of this invention will become apparent from the following description and accompanying drawings wherein.

PREFERRED ARTICLE EMBODIMENT

Figure 1:
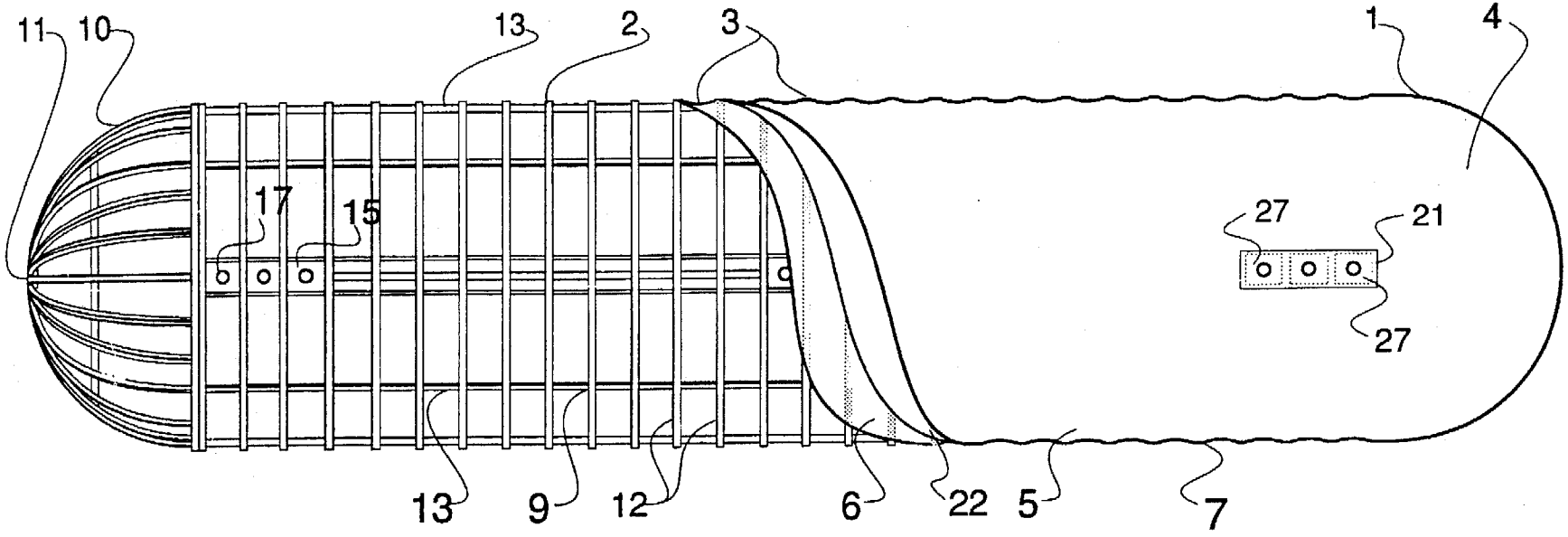
FIG. 1 is a partially sectioned top view of a preferred embodiment showing a metal tank frame skeleton surmounted by two corrugated generally cylindrical laminate structures separated by a plastic film which is made according to the present invention.

Referring now to the drawings and more particularly to FIG. 1 thereof, there is illustrated a preferred embodiment of the present invention, which includes a composite double wall underground tank structure 1. The tank structure 1 generally comprises a metal tank frame skeleton structure 2 surmounted by two concentric multiple ply laminates 3. These laminates 3 are made with the same materials using the same procedures described by Underwriters Laboratories, Inc. under UL File MH 8781 to obtain the UL 1316 Class 16 label certification.

The tank structure 1 further includes two opposite, hemispherical tank ends 4 and a plurality of the cylindrical tank shells 5 that are formed from the multiple ply laminates 3 made for instance with Dow Derakane 470-36 vinyl ester resin. The chemical resistance of laminates 3 was investigated over a 270 day period by Underwriters Laboratories, Inc. under File MH 8781, Project 92SC10462. The results of those chemical resistance tests are presented in the following Table I.

TABLE I

CHEMICAL RESISTANCE OF MH 8781 COMPOSITE TANK LAMINATES
PERCENTAGE BY WEIGHT OF FILAMENT REINFORCEMENT: 38
PERCENTAGE BY WEIGHT OF THERMOSETTING MATRIX: 62
ORIGINAL FLEXURAL STRENGTH = 18,564 PSI
ORIGINAL IZOD IMPACT STRENGTH = 22 FT-LB/IN
ORIGINAL TENSILE MODULUS = 1,181,227 PSI
PERCENT OF ORIGINAL FLEX STRENGTH AFTER IMMERSION PERIOD

| TEST LIQUID | 30 DAYS | 90 DAYS | 180 DAYS | 270 DAYS |
|---|---|---|---|---|
| AUTOMOTIVE FUELS | | | | |
| Premium Leaded Gasoline | 84 | 115 | 88 | 97 |
| Regular Unleaded Gasoline | 95 | 102 | 82 | 119 |
| No. 2 Fuel Oil | 88 | 75 | 86 | 92 |
| Fuel C | 95 | 105 | 106 | 82 |
| 100% Ethanol | 76 | 93 | 73 | 87 |
| 50% Ethanol/50% Fuel C | 82 | 82 | 76 | 76 |
| 30% Ethanol/70% Fuel C | 88 | 85 | 71 | 76 |
| 15% Ethanol/85% Fuel C | 97 | 88 | 99 | 72 |
| 10% Ethanol/90% Fuel C | 92 | 80 | 84 | 88 |
| 100% Methanol | 79 | 80 | 82 | 90 |
| 50% Methanol/50% Fuel C | 83 | 87 | 77 | 80 |
| 15% Methanol/85% Fuel C | 76 | 79 | 72 | 83 |
| Toluene | 97 | 97 | 83 | |
| ENVIRONMENTAL FLUIDS | | | | |
| Sulfuric Acid | 98 | 98 | 79 | 82 |
| Hydrochloric Acid | 81 | 90 | 80 | |
| Nitric Acid | 93 | 85 | 77 | |
| Sodium Hydroxide | 104 | 80 | 79 | |
| Saturated Sodium Chloride | 112 | 93 | 88 | 86 |
| Sodium Carbonate/ Bicarbonate | 101 | 90 | 80 | |
| Distilled Water | 108 | 103 | 115 | |
| AIR OVEN AGING AT 158° F. | | | | |
| ULTRAVIOLET LIGHT & WATER EXPOSURE | 90 | | | |

Figure 8:
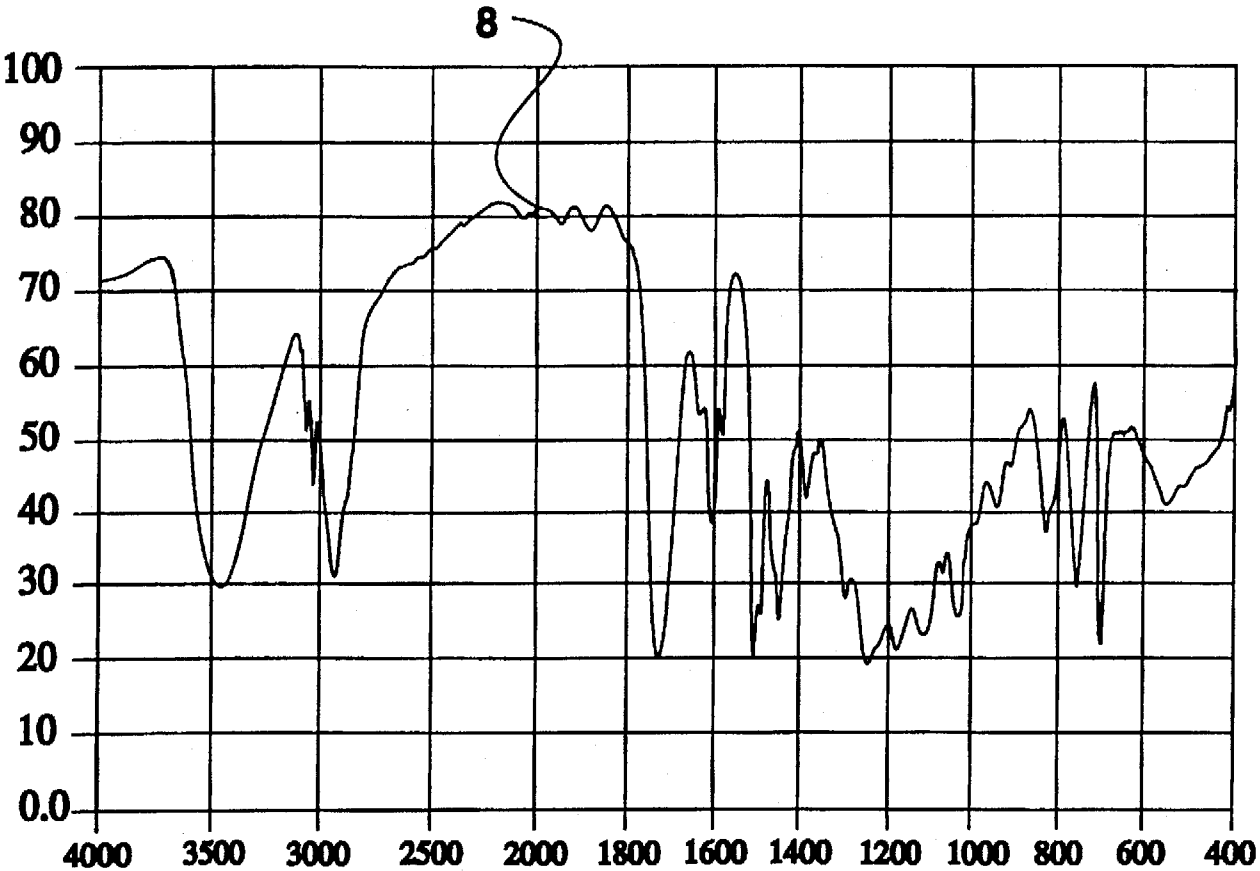
FIG. 8 is an infrared spectra trace chart obtained by means of an infrared spectrophotometer analysis of the primary and secondary tank laminate material tested by Underwriters Laboratories, Inc.

As shown in Table I, the thin 0.125 inch multiple ply laminates 3 made from the arrangement of materials according to the present invention retain in excess of 50% of their physical properties after prolonged immersion in a wide variety of fluids. Referring to FIG. 8, the infrared spectra trace 8 is obtained by means of an infrared spectrophotometer analysis of the Dow Derakane 470-36 vinyl ester resin matrix recommended as the preferred constituent of the multiple ply laminates 3 comprising the primary container and secondary container of the preferred underground tank embodiment.

Preferred Materials for Hemispherical Tank Ends 4

The materials used in the construction of a preferred embodiment of the hemispherical composite laminate structures comprising tank ends 4 of the primary and secondary containers 6 and 7, respectively are listed in Table II below.

TABLE II

THE FOLLOWING REINFORCEMENT FABRICS IMPREGNATED WITH DOW DERAKANE VINYL ESTER RESIN 470-36 TO WHICH IS ADDED A WAX-CONTAINING STYRENE SUPPRESSANT COMPRISE THE PRIMARY AND SECONDARY TANK HEMISPHERICAL HEAD LAMINATES:

| | | |
|---|---|---|
| 1st PLY: | 1.3 OZ./SQ. YD. | APERTURED POLYESTER SURFACING VEIL |
| 2nd PLY: | 13.0 OZ./SQ. YD. | UNIDIRECTED FIBERGLASS ROVING (CIRC) |
| 3rd PLY: | 1.5 OZ./SQ. FT. | CHOPPED FIBERGLASS ROVING |
| 4th PLY: | 18.0 OZ./SQ. YD. | FIBERGLASS WOVEN ROVING |
| 5th PLY: | 6.0 OZ./SQ. YD. | WOVEN FIBERGLASS CLOTH |

Figure 2:
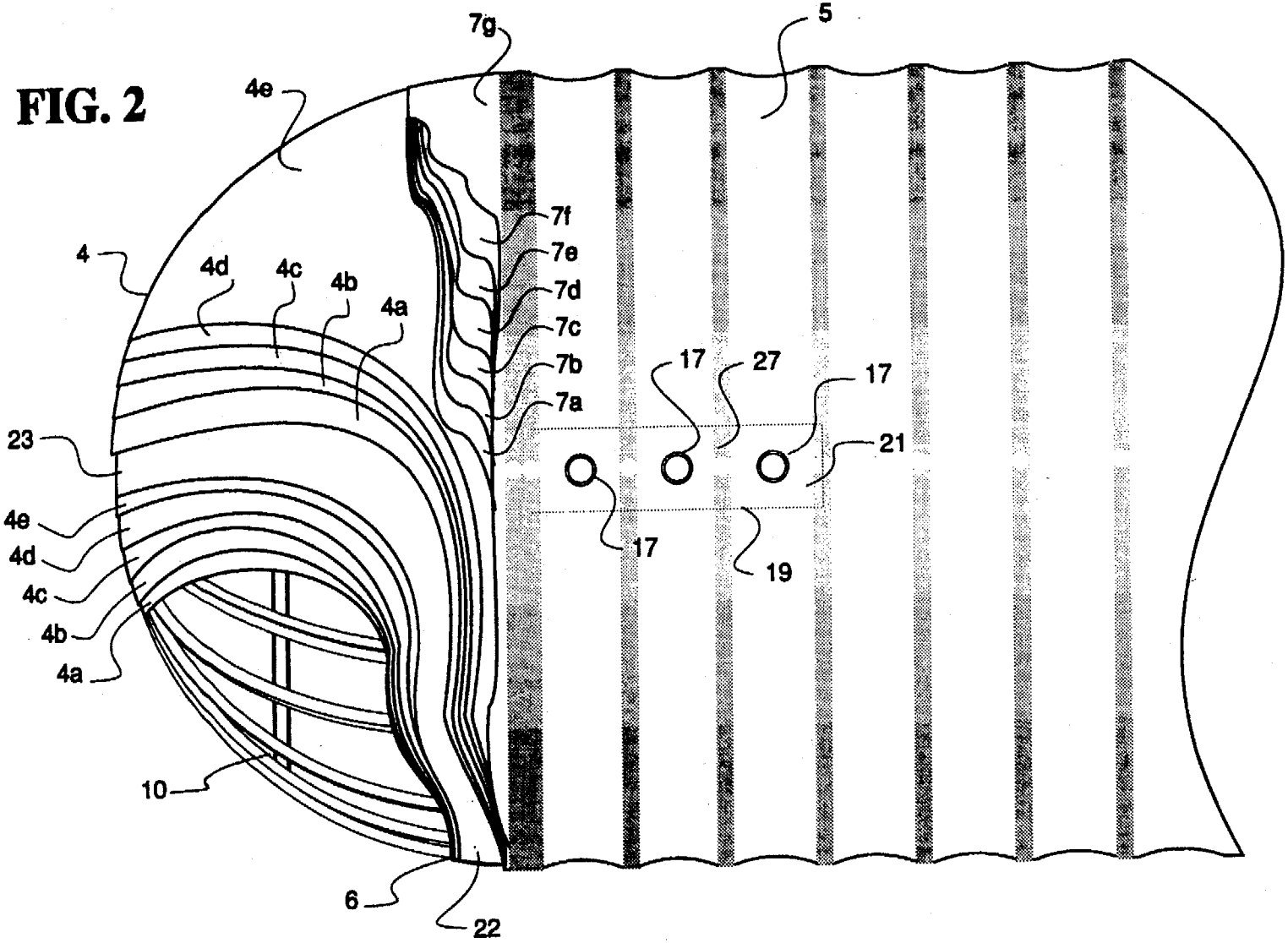
FIG. 2 is a greatly enlarged partially sectioned fragmentary top view of a tank end illustrating the multiple-ply construction of a primary and a secondary hemispherical laminate tank ends that surmount the tank frame end structure of FIG. 1.

As shown in FIG. 2. each hemispherical composite laminate structure comprises a multiple ply reinforced plastic laminate structure. While only five plies **4*a*–4*e* are illustrated, it should be understood that additional plies could be selected and used as needed. A first ply 4*a* is preferably made from overlapping trapezoidal-shaped fabrics cut from a soft apertured polyester surfacing veil having a dry weight of 1.3 ounce per square yard (44 gm/sq.m), a thickness of approximately 0.010 inch (0.25 mm), and a fabric warp width in the range of 60 to 84 inches (1.5 to 2.1 m). A second ply 4*b*** preferably includes unidirected filament fabric having circumferentially oriented continuous filament strands, a tensile strength equal to 1200 lb. per inch (21 kg/mm) of width, a dry weight of 13 ounce per square yard (442 gm/sq.m), a thickness of 0.03 inch (0.80 mm), and a warp width in the range of 48 to 72 inches (1.2 to 1.8 m).

A third ply **4*c* of overlapping trapezoidal-shaped pieces is preferably cut from a fabric of chopped strand fiberglass having a dry weight of 1.5 ounce per square yard (51 gm/sq.m),a thickness of approximately 0.015 inch (0.38 mm),and a width in the range of 60 to 84 inches (1.5 to 2.1 m). A fourth ply 4*d* of overlapping trapezoidal-shaped pieces is preferably cut from a fabric of woven fiberglass roving having a tensile strength equal to 600 lb. per inch (11 kg/mm) of width, a dry weight of 18 ounce per square yard (612 gm/sq.m), a thickness of 0.04 inch (1.00 mm) and a width in the range of 48 to 72 inches (1.2 to 1.8 m). A fifth ply 4*e*** of overlapping trapezoidal-shaped fabrics is preferably cut from woven fiberglass cloth having a tensile strength equal to 200 lb per inch (3.543 kg/mm)of width, a dry weight of 6 ounce per square yard (204 gm/sq.m), a thickness of 0.010 inch (0.25 mm), and a warp width in the range of 60 to 84 inches (1.5 to 2.1 m).

The individual laminate plies **4*a*–4*e* forming the hemispherical laminate end structure of the primary container 6 and the secondary container 7** are impregnated with a hardenable liquid vinyl ester resin matrix containing from 30 to 40% styrene monomer to which is added 1.3 percent by weight a liquid wax-containing styrene suppressant. The preferred matrix material is made by Dow USA and identified as Derakane 470-36.

Preferred Materials for Cylindrical Tank Shell Laminates 5

Figure 3:
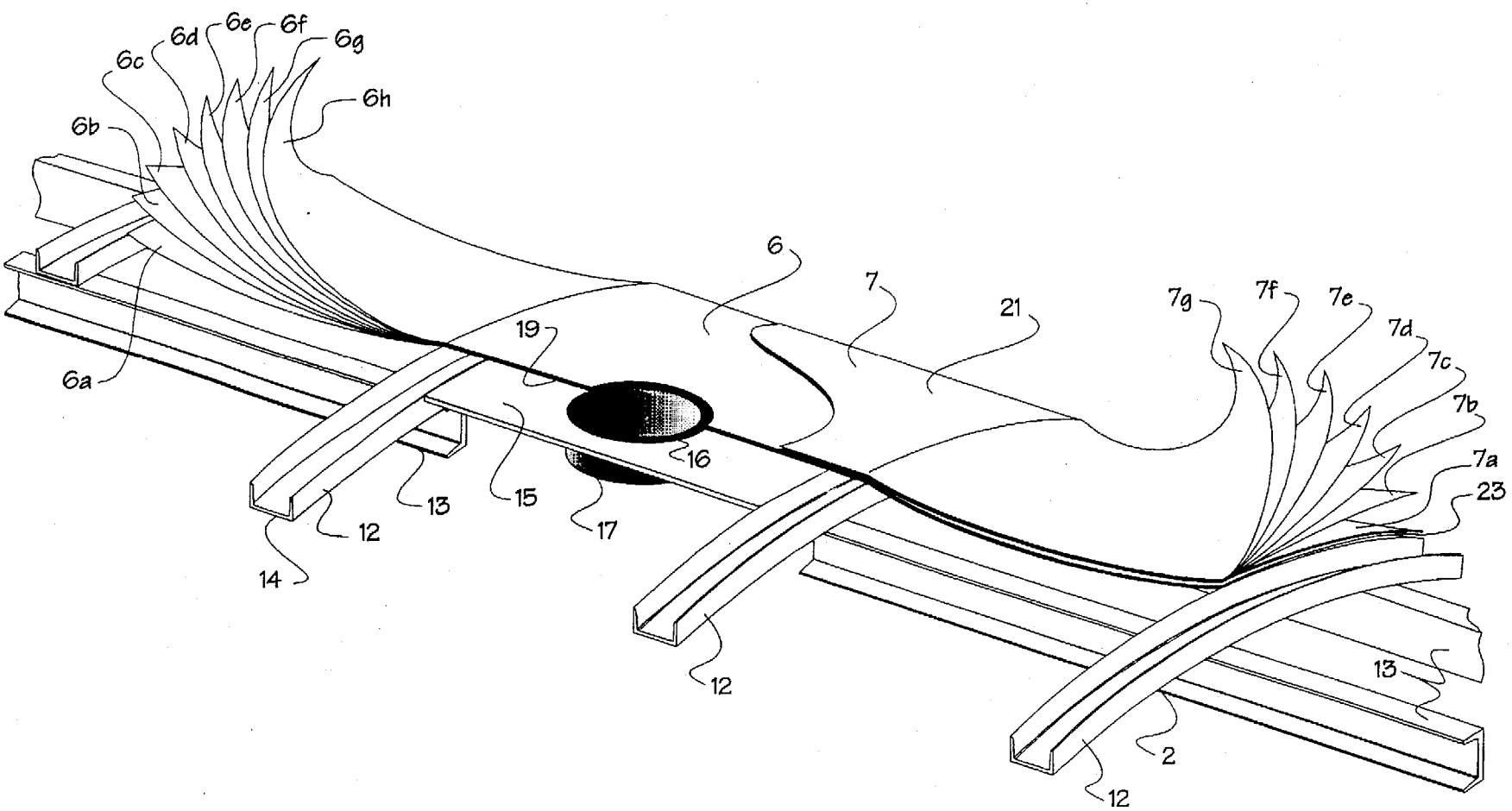
FIG. 3 is a fragmentary perspective view illustrating the multiple-ply construction of the primary and secondary cylindrical laminate structures of FIG. 2.

The preferred materials used in the construction of a preferred embodiment of the corrugated cylindrical composite laminates 5 forming the primary container 6 and secondary container 7 are shown in FIG. 3 and presented in Tables III and IV in the order of their arrangement.

TABLE III

THE FOLLOWING REINFORCEMENT FABRICS IMPREGNATED WITH DOW DERAKANE VINYL ESTER RESIN 470-36 TO WHICH IS ADDED A WAX-CONTAINING STYRENE SUPPRESSANT COMPRISE THE PRIMARY TANK CYLINDRICAL CORRUGATED LAMINATE STRUCTURES:

| | | |
|---|---|---|
| 1st PLY: | 1.0 OZ./SQ. YD. | RESINATED POLYESTER SURFACING VEIL |
| 2nd PLY: | 1.3 OZ./SQ. YD. | NON-RESINATED POLYESTER SURFACING VEIL |
| 3rd PLY: | 6.0 OZ./SQ. YD. | WOVEN FIBERGLASS CLOTH |
| 4th PLY: | 13.0 OZ./SQ. YD. | UNIDIRECTED FIBERGLASS ROVING (LONGO) |
| 5th PLY: | 1.5 OZ./SQ. FT. | CHOPPED FIBERGLASS ROVING |
| 6th PLY: | 13.0 OZ./SQ. YD. | UNIDIRECTED FIBERGLASS ROVING (CIRC) |
| 7th PLY: | 13.0 OZ./SQ. YD. | UNIDIRECTED FIBERGLASS ROVING (CIRC) |
| 8th PLY: | 6.0 OZ./SQ. YD. | WOVEN FIBERGLASS CLOTH |

TABLE IV

THE FOLLOWING REINFORCEMENT FABRICS IMPREGNATED WITH DOW DERAKANE VINYL ESTER RESIN 470-36 TO WHICH IS ADDED A WAX-CONTAINING STYRENE SUPPRESSANT COMPRISE THE SECONDARY TANK CYLINDRICAL CORRUGATED LAMINATE STRUCTURES:

| | | |
|---|---|---|
| 1st PLY: | 1.3 OZ./SQ. YD. | NON-RESINATED POLYESTER SURFACING VEIL |
| 2nd PLY: | 6.0 OZ./SQ. YD. | WOVEN FIBERGLASS CLOTH |
| 3rd PLY: | 13.0 OZ./SQ. YD. | UNIDIRECTED FIBERGLASS ROVING (LONGO) |
| 4th PLY: | 1.5 OZ./SQ. FT. | CHOPPED FIBERGLASS ROVING |
| 5th PLY: | 13.0 OZ./SQ. YD. | UNIDIRECTED FIBERGLASS ROVING (CIRC) |
| 6th PLY: | 13.0 OZ./SQ. YD. | UNIDIRECTED FIBERGLASS ROVING (CIRC) |
| 7th PLY: | 6.0 OZ./SQ. YD. | WOVEN FIBERGLASS CLOTH |

The construction of the primary container 6 onto the tank frame structure 2 prior to fabricating the secondary container 7 will now be described. The cylindrical composite laminate shell structure forming the primary container 6 is disposed on a plurality of uniformly spaced metal annular ribs 12 of the tank frame 2, and includes a plurality of plies *6a–6h*. While eight plies *6a–6h* are shown for illustration purpose, it should be understood that additional plies can be used, without departing from the scope of the invention. A first ply fabric *6a* preferably includes a stiff apertured resinated polyester surfacing veil having a dry weight of 1 ounce per square yard (34 gm/sq.m), a thickness of approximately 0.010 inch (0.25 mm), and a width in the range of 36 inches to 72 inches (91.4 cm to 183 cm). The warp threads of the first ply fabric extend generally in the direction of the longitudinal tank frame axis.

A second ply fabric *6b* preferably includes a soft apertured polyester surfacing veil having a dry weight of 1.3 ounce per square yard (44 gm/sq.m) and a thickness of approximately 0.010 inch (0.25 mm), and a width in the range 18 inches to 48 inches. The warp threads of the second ply fabric *6b* are disposed transversely to and superimposed over the warp threads of the first ply fabric *6a* to impose a substantially uniform load thereon, in order to deflect the first and second plies *6a*, *6b* into a connected plurality of corrugations, and to form a corrugated laminate having a generally concave parabolic portion between a pair of adjacent convex portions intersecting therewith, when viewed in cross section, relative to the tank frame axis. A third ply fabric *6c* is preferably made of woven fiberglass cloth having a tensile strength equal to 200 lb per inch (3.543 kg/mm)of width, a dry weight of 6 ounce per square yard (204 gm/sq.m), a thickness of 0.010 inch (0.25 mm), and a width in the range of 12 inches to 52 inches (30.4 cm to 132 cm). The warp threads of the third ply fabric *6c* are disposed approximately parallel to the warp threads of the second ply *6b* upon which the third ply *6c* is superimposed. A fourth ply fabric *6d* of unidirected continuous glass filament strands extend generally parallel to the longitudinal cylindrical axis, and has a tensile strength equal to 1200 lb. per inch (21 kg/mm) of width, a dry weight of 13 ounce per square yard (442 gm/sq.m), a thickness of 0.03 inch (0.80 mm), and a width in the range of 36 inches to 72 inches (91.4 cm to 183 cm)

A fifth ply fabric *6e* preferably includes randomly oriented chopped fiberglass strands having a dry weight of approximately 1 ounce per square yard (34 m/sq.m), a thickness of approximately 0.010 inch (0.25 mm), and a width in the range of 36 inches to 72 inches (91.4 cm to 183 cm). A sixth ply *6f* generally includes a warp of unidirected circumferentially oriented continuous glass filament strands disposed transversely to and superimposed over the fourth ply glass filament strands *6d* to impose a substantially uniform load thereon. The sixth ply warp *6f* has a tensile strength equal to 1200 lb. per inch (21 kg/mm) of width, a dry weight of 13 ounce per square yard (442 gm/sq.m), a thickness of 0.03 inch (0.08 mm), and a width in the range of 4 to 60 inches (10 to 150 cm).

A seventh ply *6g* preferably includes a warp of unidirected continuous glass filament strands, superimposed upon and disposed approximately parallel to the sixth ply glass filament strands *6f*, and has a tensile strength equal to 1200 lb. per inch (21 kg/mm) of width, a dry weight of 13 ounce per square yard (442 gm/sq.m), a thickness of 0.03 inch (0.08 mm), and a width in the range of 4 to 60 inches (10 to 150 cm). An eighth ply fabric *6h* is preferably made of woven fiberglass cloth having a tensile strength equal to 200 lb per inch (3.543 kg/mm)of width, a dry weight of 6 ounce per square yard (204 gm/sq.m) and a thickness of 0.010 inch (0.25 mm).

The construction of the secondary container 7 onto the primary container 6 will now be described. A plastic annulus-forming sheet 22 is used to completely enclose and cover the cylindrical composite laminate shell structure *6h* of the primary container 6, except for the tank outlet laminate regions 19, as illustrated in FIGS. 2 and 3, where the primary and secondary cylindrical laminates are bonded together. An annulus space 23 between the primary and secondary cylindrical composite laminate tank shells 5, formed by the intermediate plastic sheet 22, is preferably less than 0.06 inches (1.5 mm) to enable the outer secondary tank shell 7 to protect as well as to structurally reinforce the inner primary tank shell 6, when the double-wall tank 1 is subjected to shipping and handling impacts and to tank shell stresses resulting from internal pressure or installation-produced compression loads.

Except for the first ply fabric *6a*, the cylindrical composite laminate shell structure forming the secondary container 7 is preferably made of the same materials as the composite laminate shell structure forming the primary container 6, and in the same sequence. A first ply fabric 7a comprises a soft apertured polyester surfacing veil. A second ply fabric 7b is made of woven fiberglass cloth. A third ply fabric 7c includes unidirected longitudinally oriented filament strands. A fourth ply fabric 7d includes chopped fiberglass strands. A fifth ply 7e and sixth ply 7f include circumferentially oriented continuous glass filament strands. A seventh outer ply 7g comprises woven fiberglass cloth. The individual laminate plies forming the cylindrical laminate structure of the primary container 6 and secondary container 7 are impregnated with a hardenable liquid vinyl ester resin matrix containing from 30 to 40% styrene monomer to which is added 1.3 percent by weight a liquid wax-containing styrene suppressant. The preferred matrix material is made by Dow USA and identified as Derakane 470-36.

Preferred Tank Frame 2

FIG. 1 illustrates the preferred form of the metal tank frame 2 which includes a generally cylindrical laminate-forming metal mandrel structure 9 connected to hemispherical-shaped metal skeleton end structures 10 that provide the tank frame with axle supports 11 (FIG. 6) that enable the tank frame to be rotated while supported at the frame extremities by a tank frame turning unit (not shown). The cylindrical tank frame structure 9 is made from uniformly spaced annular metal ribs 12 supported by nine metal longerons 13 having ends connected to the hemispherical-shaped metal tank ends 10 that accept removable threaded axles (not shown) connected to a powered tank frame turning unit.

Figure 9A:
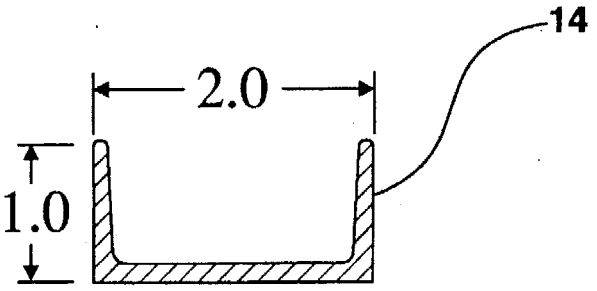
FIG. 9A is a section view of a metal channel section used to make tank frame ribs in a preferred embodiment of the invention.

The preferred frame outside diameter is 95 inches (241 cm). The preferred material from which to construct the tank frame ribs 12, the frame longerons 13 and each of the hemispherical end support structures 10 is carbon steel channel 14 shown in FIG. 9 having a cross section area of approximately 0.5 square inches (3.23 sq.cm), a channel material thickness of approximately 0.125 inches (0.32 cm), a channel flange height of 1.0 inches (2.54 cm), and a channel web width of 2.0 inches (5.08 cm).

Figure 9B:
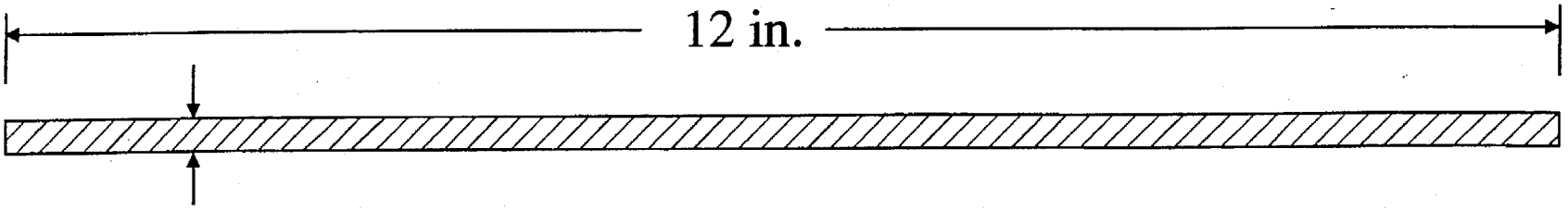
FIG. 9B is a section view of a 12-inch long steel plate ¼ inch thick, typical of conventional tanks.

When the tank frame ribs 12 are made from steel channel 14 spaced 12 inches apart, they will provide the tank frame structure 2 with a compression strength and buckle-resistant stiffness (proportional to the moment of inertia, I, of the cross sectional area) that is twice as great as that of a UL listed steel tank structure (U.L. subject 1316), and do so with one-sixth the weight of the steel tank. The steel channel 14 shown in FIG. 9A has a moment of inertia, I, equal to 0.0362 $in^4$ and cross sectional area equal to 0.04576 $in^2$. By comparison (as shown in FIG. 9B), the moment of inertia of a 12 inch long steel plate ¼ inch thick, typical of Subject 58 tanks, is equal to 0.0156 $in^4$ and a cross sectional area is equal to 3 square inches.

Figure 7:
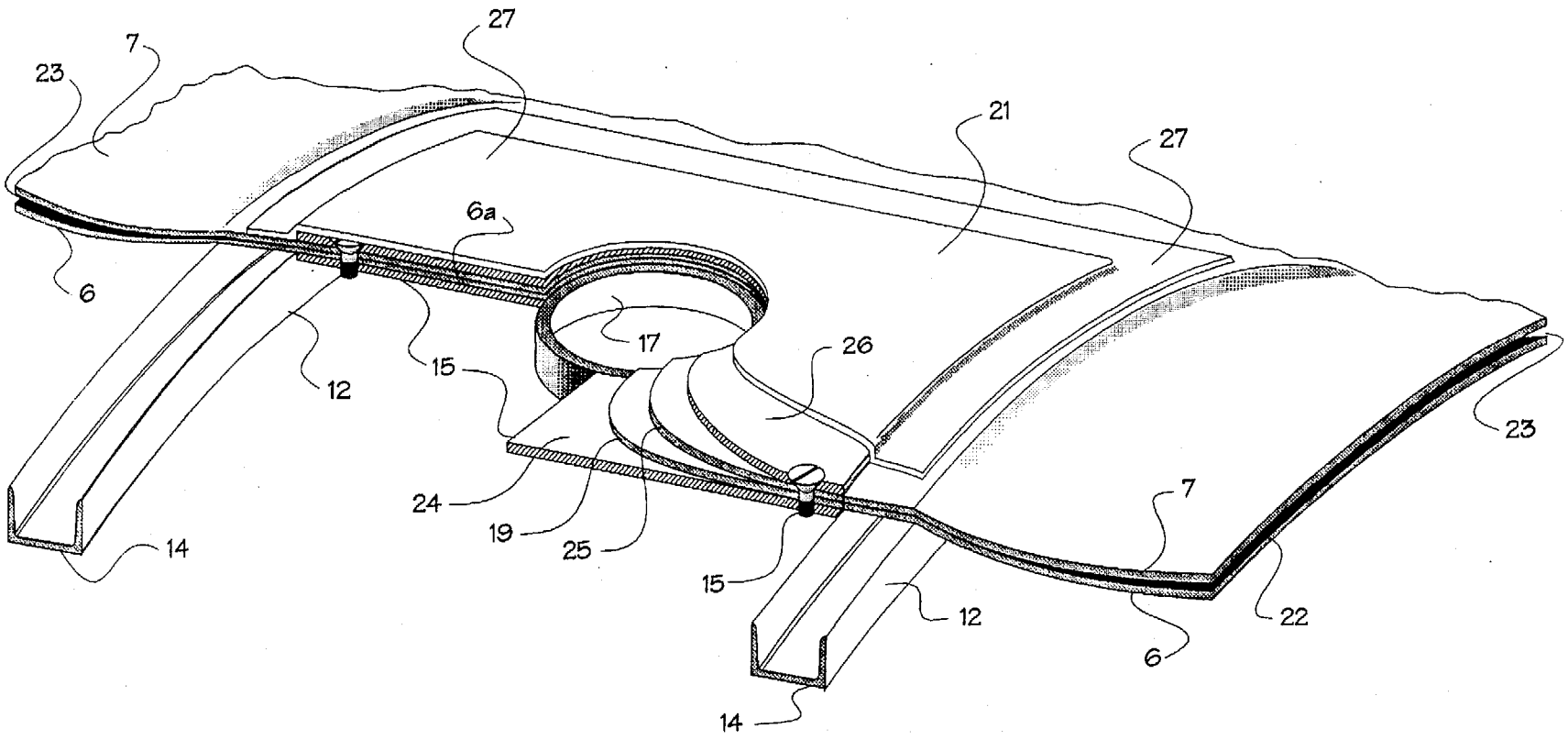
FIG. 7 is a fragmentary perspective cross section view illustrating a tank outlet laminate sealing structure overlapping tank outlet openings in the primary and secondary cylindrical laminate structures contained between a metal outlet compression plate bolted to a metal tank outlet fitting plate.

As shown in FIGS. 3 and 7, each outlet fitting plate 15 is welded to the tank frame 2 and is flush with the tank frame rib cylindrical outer surface and located on the uppermost portion of the tank frame between the tank frame ribs. Each outlet fitting plate 15 is made from a curved steel plate welded to the outer edges of adjacent tank frame ribs. The outlet fitting plates 15 contain openings 16 (FIG. 3) that provide access to the tank interior via pipe outlet fittings 17. Each of the outlet fitting plates 15 is constructed to have at least 100 square inches of perimeter surface 18 to which the interior outlet region 19 of the primary container laminate surface can be bonded and sealed.

Preferred Tank Outlet Embodiment 20

FIG. 7 illustrates a preferred embodiment of a composite double-wall tank fitting outlet structure 20 including non-corrugated outlet regions 21 of the cylindrical laminate structures 5 bonded together and sandwiched between two curved metal outlet plates and sealed with an overlapping laminate structure 27. The interior curved metal fitting plate 15, containing at least one outlet fitting 17, is welded to adjacent tank frame annular ribs 12 made of steel channel material to provide an outer fitting plate surface 24 that is flush with the exterior edge of the tank frame rib.

The interior surface of the tank outlet regions of the primary tank laminate structure 19 is bonded to metal fitting plate surfaces 24 with the thermosetting resin matrix used to impregnate the laminate ply reinforcements of the primary container 6. The exterior laminate surface of the primary tank outlet regions 19 is likewise bonded to the interior laminate surface of the secondary tank outlet regions 25. The laminate outlet regions bonded to the tank outlet fitting plate 15 and to each other have a bonding surface area at least equal in area to that of the metal fitting plate surface. An outer curved metal tank outlet compression plate 26 is bolted to the interior metal outlet plate 15, and surmounts and is bonded to the exterior surface of the secondary laminate outlet region 25. The exterior surface edges surrounding the outlet opening of the bolted metal compression plate 26 is covered by an outlet laminate sealing structure 27 that overlaps the surface edges and is bonded to a width of the exterior surface of the secondary tank outlet region surrounding the compression plate 26.

Preferred Annulus Access Structure Embodiment

Figure 4:
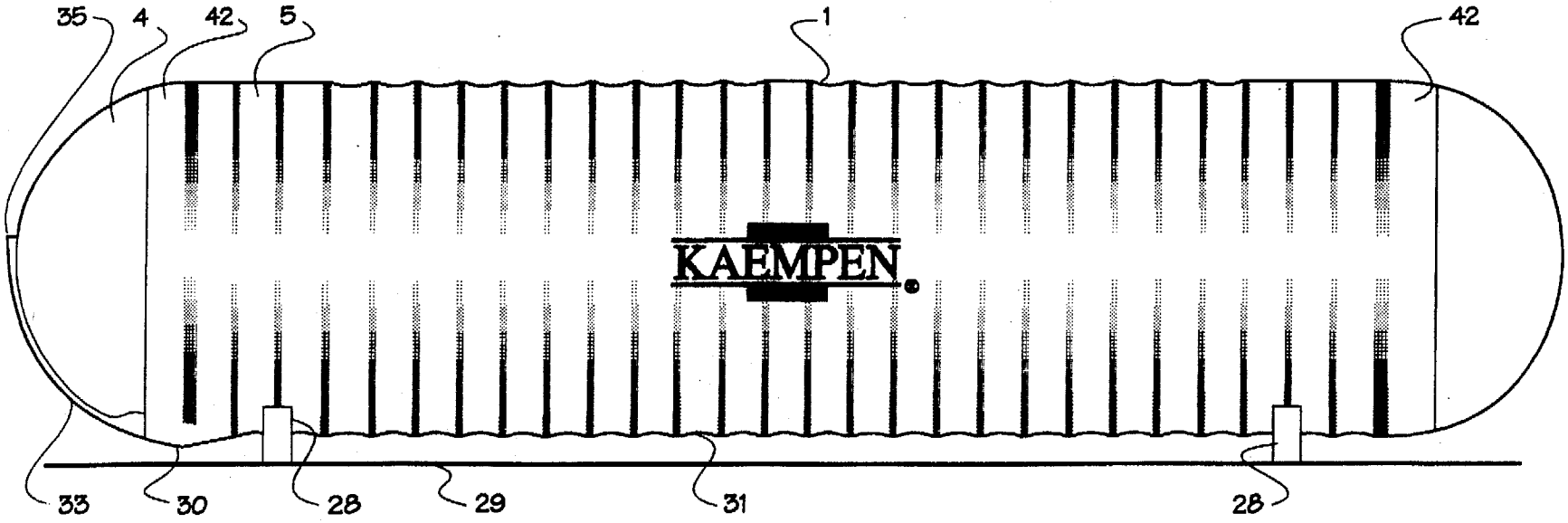
FIG. 4 is a side elevation view of a preferred embodiment showing tank support saddles, an annulus access, and an annulus sump constructed as part of the secondary hemispherical laminate tank end of FIGS. 2 and 3.

FIG. 4 illustrates a preferred embodiment of the double-wall underground storage tank 1 having tank support saddles 28 that elevate the tank bottom above a tank support surface 29 to prevent damage to the annulus sump 30 and facilitate inspection of the tank bottom 31.

Figure 5:
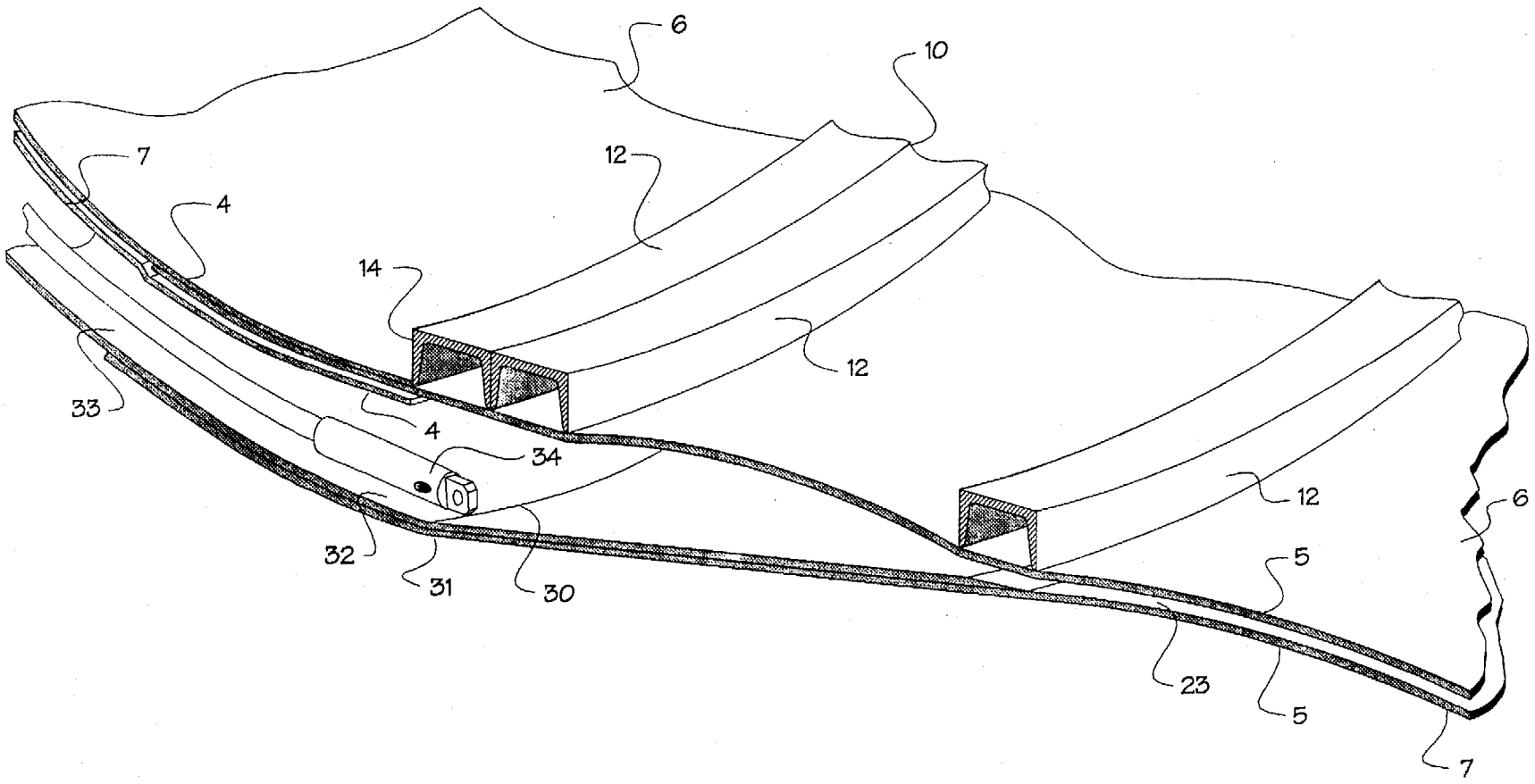
FIG. 5 is a fragmentary isometric projection of a cross section of a bottom central portion of the two hemispherical laminate tank ends showing the annulus access conduit and the bottom annulus sump structure containing a leak detection sensor.

FIG. 5 illustrates a preferred annulus access structure 32 comprising a secondary container hemispherical laminate tank end 4 configured to provide an annulus sump access conduit 33 that enables a flexible dip stick or leak detecting sensor system 34 to monitor the tank's containment integrity. The upper end of the composite annulus access structure contains a threaded-end metal pipe. The tank support saddle 28 comprises a multiple ply composite laminate structure having a wall thickness of approximately 0.25 inches (6 mm) and bonded to the bottom outer tank surface to provide a foot print measuring approximately 6 inches by 48 inches.

Preferred Frame Support Axle Access

Figure 6:
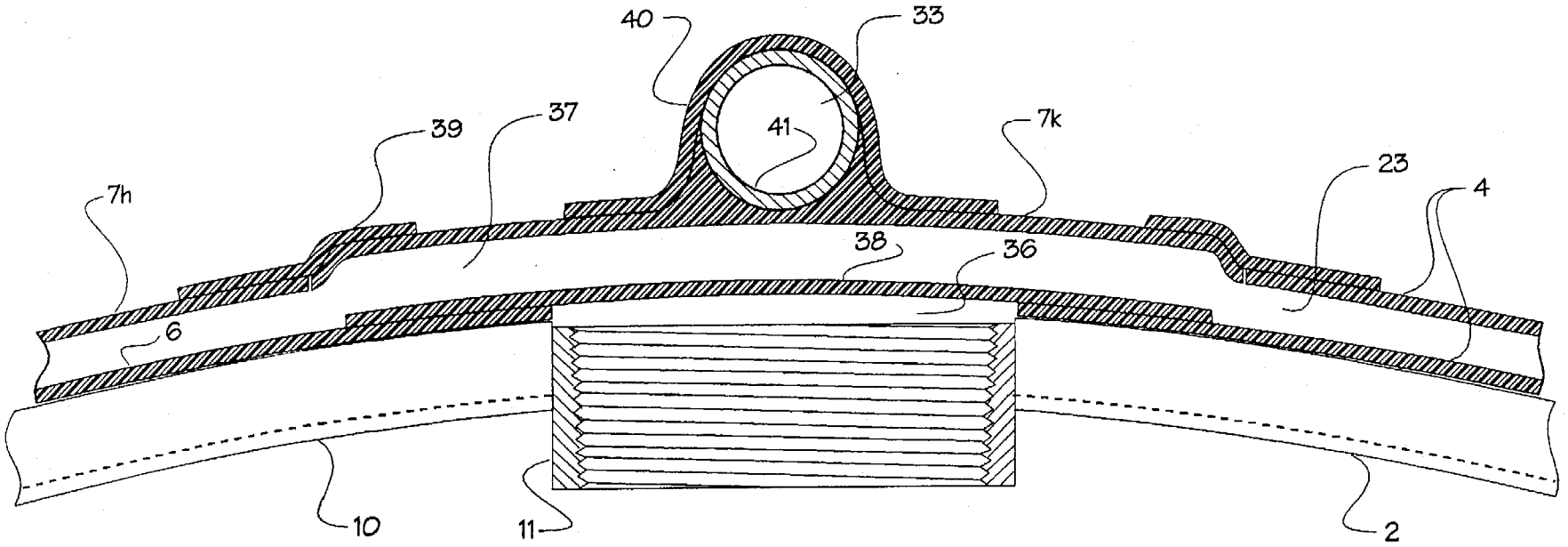
FIG. 6 is a partial cross sectional top view showing the annulus access conduit, the threaded axle support fitting and the composite laminates used to seal the axle access holes in the primary and secondary hemispherical laminate tank ends.

FIG. 6 shows a preferred frame support axle access including composite head seal laminates 38 and 39 used to seal a primary tank axle access hole 36 as well as a secondary tank access hole 37. The holes 36, 37 provide a means for the tank frame support axles (not shown) of the tank turning unit to be connected to the metal tank frame axle support structure 11. The primary tank hemispherical end 4 comprises a 5 inch diameter axle hole 36 sealed by a five ply head seal laminate structure 38 having a diameter of approximately 10 inches. The laminate structure 38 comprises a first ply of 1.5 oz./sq. yd. fiberglass mat, a second ply of 18 oz/sq.yd. woven fiberglass roving, a third ply of fiberglass mat, a fourth ply of woven roving and a fifth ply of 6 oz/sq. yd. woven fiberglass fabric. A secondary tank hemispherical end 7h comprises a 14 inch diameter axle hole 37 and a 14 inch diameter circular head closure laminate structure 7k that may include a portion of the annulus sump access conduit 33. The secondary tank access hole 37 is sealed by a five ply annular head seal laminate structure 39 having an inside diameter of 10 inches and an outer diameter of 18 inches, and is composed of the same materials as the primary tank head seal laminate 38. A conduit pipe laminate 40 includes a similar 5 ply laminate construction, and is used to attach a metal annulus access pipe 41 to the annulus sump access conduit 33.

Preferred Head to Shell Anchor Ring Embodiment

FIG. 4 shows the preferred embodiment of a composite head to shell anchor ring structure 42, which is a filament wound around an end extremity of each hemispherical tank end 4, to anchor the longitudinal continuous filament strands 6*d* forming the 4th ply of the primary tank shell cylindrical corrugated laminate to the outer ply 4*e* of the primary hemispherical tank end laminate, and the 3rd ply of the secondary tank shell cylindrical laminate 7*c* to the outer ply 4*e* of the secondary hemispherical tank end laminate 7*h*. The primary tank head to shell anchor ring is preferably composed of the circumferentially oriented continuous filament strands comprising the beginning and ending winding of the sixth and seventh primary tank circ plies 6*f* and 6*g*. The secondary tank head to shell anchor ring is preferably composed of the circumferentially oriented continuous filament strands forming the beginning and ending winding of the fifth and sixth secondary tank circ plies 7*e* and 7*f*.

Preferred Method and Apparatus

The following steps describe a preferred method and apparatus for making the preferred embodiment illustrated in FIG. 1. The preferred method and apparatus described below were used to make an eight foot diameter 12,000 gallon size double-wall non-metallic underground tank tested by Underwriters Laboratories, Inc. Aug. 5, 1993 to demonstrate that the tank fully complies with the requirements of UL 1316 Type II Class 16.

The preferred method for making a desired form of composite double-wall underground tank comprises the steps of:

- cutting channel-shaped steel 14 from 30 foot long stock to the lengths required to make an integral tank mandrel and head support structure 10 from 8 foot diameter steel frame ribs 12, frame longerons 13 and head formers;
- shaping annular ribs and hemispherical frame head forming members in a ring-rolling unit;
- fabricating in a welding jig the annular ribs 12 and longerons 13 into cylindrical tank frame sections having ribs spaced 12 inches apart and lengths of either 4.5 ft. or 5.5 feet;
- fabricating the hemi-head members in a welding jig to make the hemispherical frame end sections 10 and frame axle support structure 11;
- assembling the tank frame cylinder 9 from cylindrical tank frame sections and hemispherical head sections 10 to make an axle-supported tank mandrel 2;
- forming steel fitting plate stock to have an outer surface radius equal to that of the tank frame ring outer radius;
- cutting tank outlets from the curved fitting plate stock and trimming so fitting plates will fit between tank frame rings;
- welding steel half couplers 17 to the inner surface of tank outlet fitting plates 15;
- welding the tank outlet fitting plates 15 to the perimeter edge of tank frame ribs 12 bordering each fitting plate;
- welding strike plates beneath all tank outlet fitting plates;
- making first hemispherical composite laminate tanks ends 4 from a five-ply sequence of overlapping trapezoidal-shaped fabrics impregnated with a thermo-setting plastic and fabricated upon hemispherical tank end molds;
- attaching prefabricated first hemispherical composite laminate tank ends 4 upon the hemispherical frame end-support structure 10 of the completed tank frame mandrel 2;
- mounting the tank end and frame assembly 2 upon a motorized tank frame turning unit;
- grinding the external surface 24 of each tank outlet fitting plate 15 to produce a clean "white metal" surface;
- bonding a three ply layer of resin-impregnated polyester surfacing veil 6*a* to the freshly ground surface of each tank outlet fitting plate 15;
- cutting to length and bonding to the perimeter edge of each hemispherical composite laminate tank end 4 a 9 inch wide overlapping end portion of individual widths of dry stiff resinated apertured polyester surfacing veil 6*a* that is stretched as a taut fabric to cover the spaced tank frame ribs 12;
- impregnating with a liquid thermosetting resin a warp of soft non-resinated apertured polyester surfacing veil 6*b* dispensed from a fabric-roll coater;
- helically wrapping, from one tank end to the other, a resin-wet warp of polyester surfacing veil 6*b* upon the dry taut polyester veil fabric 6*a;*
- impregnating and deflecting the dry taut fabric 6*a* between the tank frame ribs 12 to produce a corrugated resin-wet two-ply laminate surface;
- covering the corrugated wet laminate surface with a sequence of parallel widths of dry tightly woven 6 ounce per square yard fiberglass cloth 6*c;*
- pressing the dry fiberglass cloth 6*c* to intimately contact the corrugated resin-wet two-ply laminate surface;
- impregnating the glass cloth fabric 6*c* with a liquid thermosetting resin to produce a three-ply liner laminate structure;
- attaching to each tank end 4 a 9 inch overlapping edge of a width of dry unidirected longo ply fabric 6*d* comprising continuous strands of glass fiber oriented parallel to the tank frame axis and having an outer surface consisting of a mat layer of chopped fiberglass roving 6*e;*
- placing additional similarly-attached parallel widths of dry unidirected longo ply fabrics upon the corrugated three-ply liner laminate surface that completely encloses the tank frame 2;
- impregnating with a liquid thermosetting polymeric resin matrix a warp of unidirected circ ply fabric 6*f* comprising continuous strands of glass fiber;
- attaching the leading edge of the circ ply fabric 6*f* to one of the dry longo ply fabrics 6*d* bonded to a first tank end 4 so that an edge of the circ ply warp 6*f* overlaps, by approximately 9 inches, the edge extremity of a primary hemispherical composite laminate tank end 4;
- making a single circumferentially-oriented wrap of the resin-wet circ ply warp 6*f* upon the dry end-bonded longo ply fabric 6*d* to provide a first head-to-shell anchor ring 42;
- helically winding a first edge-abutting sequence of resin-wet circ ply warps 6*f* to press upon and impregnate the dry longo ply fabric 6*d* from a first tank end to a second tank end;
- winding two circumferential wraps of the matrix-impregnated circ ply fabric 6*g* upon the dry longo ply 6*d* and glass mat fabrics 6*c* overlapping the edge extremity of a second primary hemispherical head end 4 to provide a second shell-to-head anchor ring 42;
- helically winding, from a first tank end to a second tank end, a second edge-abutting sequence of resin-wet circ ply warps 6*g;* wrapping a single cover ply of dry tightly woven 6 ounce per square yard fiberglass cloth 6h upon the wet plies of circ fabric 6g;

inspecting the tank outlet fitting plate surfaces 24 to assure that the resin-impregnated inner tank laminate plies 6a are in void-free intimate contact with the tank outlet fitting plate surfaces 24;

painting the primary tank 6 shell exterior surface with an opaque thermosetting resin;

curing the primary tank shell laminate matrix and cover ply resins;

covering completely the primary tank cylindrical composite laminate structure with an opaque 6 mil thick polyethylene plastic sheet 22 that overlaps a 12 inch wide extremity of each primary hemispherical composite laminate tank end 4;

cutting and removing the plastic sheet 22 around the tank outlet fitting plate 15 bonding areas;

removing the primary tank 6 from the turning support unit;

making second hemispherical composite laminate tanks ends 4 from a six-ply sequence of overlapping trapezoidal-shaped fabrics impregnated with a thermosetting plastic and fabricated upon hemispherical tank end molds, wherein one of said tank end molds is configured to provide a hemispherical composite laminate tank end having an integral annulus access 32 and bottom sump structure 30;

placing the prefabricated second hemispherical composite laminate tank ends 7h upon the prefabricated primary tank first hemispherical composite laminate tank ends 4;

mounting the primary tank and second tank ends upon a motorized tank frame turning unit;

grinding the exterior surface of the primary tank shell laminate in those regions 19 where it is bonded to the underlying tank metal outlet fitting plates 15;

making the secondary cylindrical composite laminate tank shell structure 7g by repeating the same procedures with the same materials as those used to make the primary cylindrical composite laminate tank shell structure 6h;

cutting tank outlet holes 16 through primary and secondary cylindrical composite laminate structures at all tank fitting outlet locations;

bolting metal compression plates 26 to all metal outlet fitting plates 15;

placing a three-ply laminate 27 to overlap and cover the edges of all bolted metal compression plates 26 to seal all tank outlet fittings;

installing a lift lug in a central tank outlet fitting 17;

lifting and removing the completed double wall tank structure from the mandrel turning support unit;

laminating a composite seal to cover the axle access openings 36 and 37 in the primary and secondary composite hemispherical ends that provide the turning support unit with access to the steel frame axle fittings; and leak testing the primary and secondary containers 6 and 7 by simultaneously pressurizing both containers to 5 psi.

While the preferred and other embodiments have been described above, it should be understood that other embodiments are also contemplated within the scope and spirit of the present invention.

I claim:

1. A method for fabricating a multiple wall tank structure comprising the steps of:

forming a metal frame with at least one outlet fitting plate;

surmounting said metal frame, at least partially, with an impermeable non-metallic primary container including a chemically resistant multiple-ply laminate structure, said primary container including at least one primary outlet panel disposed in registration with, and bonded to said at least one outlet fitting plate;

surmounting said primary container, at least partially, with an impermeable non-metallic secondary container including a chemically resistant multiple-ply laminate structure, said secondary container including at least one secondary outlet panel disposed in registration with, and bonded to said at least one primary outlet panel, whereby said at least one outlet fitting plate, said at least one primary outlet panel and said at least one secondary outlet panel forming a corresponding at least one pressure-resistant outlet seal;

forming a space between said primary and secondary containers; and providing said secondary container with an annulus access conduit opening for enabling said space between said primary and secondary containers to be connected by said conduit to the atmospheric pressure.

2. A method for making a composite double-wall underground tank comprising the steps of:

cutting channel-shaped steel from 30 foot long stock into a plurality of steel sections each having a length, wherein said lengths of said steel sections are suitable to make a plurality of 8 foot diameter annular steel frame ribs, a plurality of frame longerons, and a plurality of hemispherical frame head forming members from said steel sections, said annular ribs, said frame longerons, and said hemispherical frame head forming members formable into an integral axle-supported tank mandrel and a head support structure;

shaping in a ring rolling unit said plurality of annular steel frame ribs and said plurality of hemispherical frame head forming members from a portion of said plurality of steel sections;

fabricating in a welding jig said annular steel frame ribs and said frame longerons into cylindrical tank frame sections having ribs spaced 12 inches apart and lengths of either 4.5 ft. or 5.5 feet, each tank frame rib defining two outer edges, said tank frame ribs defining a tank frame ring having an outer radius;

fabricating in a welding jig said hemispherical frame head forming members into hemispherical frame end sections and frame support axles;

assembling said integral axle-supported tank mandrel from said cylindrical tank frame sections and said hemispherical frame head sections;

forming steel fitting plate stock to have an outer surface radius equal to that of said tank frame ring outer radius;

cutting tank outlet fitting plates having outlet fittings from said curved fitting plate stock and trimming said tank outlet fitting plates so that said tank outlet fitting plates will fit between said tank frame ribs;

welding steel half couplers to the inner surface of said tank outlet fitting plates;

welding said tank outlet fitting plates to said integral axle-supported tank mandrel such that each tank outlet fitting plate is welded to the outer edges of two tank frame ribs and said tank outlet fitting plates are positioned adjacent each other with said tank frame ribs intervening between them, said tank outlet fitting plates then defining an external surface facing the exterior of said integral axle-supported tank mandrel;

welding strike plates beneath each of said tank outlet fitting plates;

making primary hemispherical composite laminate tank ends from a five-ply sequence of overlapping trapezoidal-shaped fabrics impregnated with a thermosetting plastic and fabricated upon hemispherical tank end molds, said primary hemispherical composite laminate tank ends having primary axle access openings, said primary hemispherical composite laminate tank ends each defining a perimeter edge;

attaching said primary hemispherical composite laminate tank ends upon said hemispherical frame end sections assembled into said integral axle-supported frame mandrel;

mounting said primary hemispherical composite laminate tank ends and said frame support axles upon a motorized tank frame turning unit using said primary axle access openings;

grinding said external surface of each of said tank outlet fitting plates to produce a clean "white metal" surface;

bonding a three ply layer of resin-impregnated polyester surfacing veil to said "white metal" surface of each of said tank outlet fitting plates;

cutting to length and bonding to said perimeter edge of each primary hemispherical composite laminate tank end a 9 inch wide overlapping end portion of individual widths of dry stiff resinated apertured polyester surfacing veil that is stretched as a taut fabric, such that said dry taut fabric polyester surfacing veil covers said spaced tank frame ribs;

impregnating with a liquid thermosetting resin a primary warp of soft non-resinated apertured polyester surfacing veil dispensed from a fabric-roll coater;

helically wrapping, from said perimeter edge of a first primary hemispherical composite laminate tank end to said perimeter edge of a second primary hemispherical composite laminate tank end, said resin-wet primary warp of polyester surfacing veil upon said dry taut fabric polyester surfacing veil;

impregnating and deflecting said dry taut fabric polyester surfacing veil between the tank frame ribs to produce a corrugated resin-wet two-ply laminate surface;

covering said corrugated resin-wet two-ply laminate surface with a primary sequence of parallel widths of dry tightly woven 6 ounce per square yard fiberglass cloth;

pressing said primary sequence of parallel widths of dry fiberglass cloth to intimately contact said corrugated resin-wet two-ply laminate surface;

impregnating said primary sequence of parallel widths of dry fiberglass cloth with a liquid thermosetting resin to produce a primary three-ply liner laminate structure;

attaching to said perimeter edge of each primary hemispherical composite laminate tank end a 9 inch wide overlapping edge of a width of a primary dry unidirected longo ply fabric comprising continuous strands of glass fiber oriented parallel to the tank frame axis and having an outer surface consisting of a primary mat layer of chopped fiberglass roving;

placing additional similarly-attached parallel widths of said primary dry unidirected longo ply fabric upon said primary three-ply liner laminate structure that completely encloses the tank frame;

impregnating with a liquid thermosetting polymeric resin matrix a warp of a primary unidirected circ ply fabric comprising continuous strands of glass fiber and having a leading edge;

attaching said leading edge of said warp of said resin-wet primary unidirected circ ply fabric to one of said widths of said primary dry unidirected longo ply fabric bonded to said first primary hemispherical composite laminate tank end so that an edge of said warp of said resin-wet primary unidirected circ ply fabric overlaps, by approximately 9 inches, the edge extremity of said first primary hemispherical composite laminate tank end;

making a single circumferentially-oriented wrap of said warp of said resin-wet primary unidirected circ ply fabric upon said primary dry unidirected longo ply fabric to provide a portion of a first primary shell-to-head anchor ring;

helically winding a first edge-abutting sequence of said resin-wet primary unidirected circ ply fabric to press upon and impregnate said primary dry unidirected longo ply fabric from said first primary hemispherical composite laminate tank end to said second primary hemispherical composite laminate tank end;

winding two circumferential wraps of said resin-wet primary unidirected circ ply fabric upon said primary dry unidirected longo ply fabric and said primary sequence of parallel widths of dry fiberglass cloth overlapping by approximately 9 inches the edge extremity of said second primary hemispherical composite laminate head end to provide a second primary shell-to-head anchor ring;

helically winding, from said perimeter edge of said second primary hemispherical composite laminate tank end to said perimeter edge of said first primary hemispherical composite laminate tank end, a second edge-abutting sequence of said resin-wet primary unidirected circ ply fabric;

making a single circumferentially oriented wrap of said warp of said resin-wet primary unidirected circ ply fabric to complete the first primary shell-to-head anchor ring;

wrapping a single primary cover ply of a dry tightly woven 6 ounce per square yard fiberglass cloth upon said just-wound matrix-impregnated primary unidirected circ ply fabric, all of said resin-impregnated inner tank laminate plies applied to said integral axle-supported tank mandrel forming a primary cylindrical composite laminate tank shell structure having an exterior surface, said primary cylindrical composite laminate tank shell structure and said integral axle-supported tank mandrel together forming a primary tank;

inspecting said tank outlet fitting plate surfaces to assure that said dry taut fabric polyester surfacing veil is in void-free intimate contact with said tank outlet fitting plate surfaces;

curing the primary laminate matrix resins forming said primary cylindrical composite laminate tank shell structure;

covering completely said primary cylindrical composite laminate tank structure with an opaque 6 mil thick polyethylene plastic sheet that overlaps a 12 inch wide extremity of each primary hemispherical composite laminate tank end;

cutting and removing said plastic sheet around the tank outlet fitting plate bonding areas;

removing said primary tank from said motorized tank frame turning unit;

making secondary hemispherical composite laminate tank ends from a five-ply sequence of overlapping trapezoidal-shaped fabrics impregnated with a thermosetting plastic and fabricated upon hemispherical tank end molds, said secondary hemispherical composite laminate tank ends having secondary axle access openings, wherein one of said tank end molds is configured to provide a hemispherical composite laminate tank end having an integral annulus access and bottom sump structure;

placing said secondary hemispherical composite laminate tank ends upon said primary hemispherical composite laminate tank ends;

mounting the primary tank and the secondary hemispherical composite tank ends placed upon said primary hemispherical composite laminate tank ends upon said motorized tank frame turning unit using said primary and secondary axle access openings;

grinding the exterior surface of said primary cylindrical composite laminate tank shell structure in those regions where it is bonded to said underlying tank outlet fitting plates;

making a secondary cylindrical composite laminate tank shell structure by:

impregnating with a liquid thermosetting resin a secondary warp of soft non-resinated apertured polyester surfacing veil dispensed from a fabric-roll coater;

helically wrapping, from said perimeter edge of a first secondary hemispherical composite laminate tank end to said perimeter edge of a second secondary hemispherical composite laminate tank end, said resin-wet secondary warp of polyester surfacing veil upon said plastic sheet;

covering said resin-wet secondary warp of polyester surfacing veil with a secondary sequence of parallel widths of dry tightly woven 6 ounce per square yard fiberglass cloth;

pressing said secondary sequence of parallel widths of dry fiberglass cloth to intimately contact said resin-wet secondary warp of polyester surfacing veil;

impregnating said secondary sequence of parallel widths of dry fiberglass cloth with a liquid thermosetting resin to produce a secondary two-ply liner laminate structure;

attaching to said perimeter edge of each secondary hemispherical composite laminate tank end a 9 inch wide overlapping edge of a width of a secondary dry unidirected longo ply fabric comprising continuous strands of glass fiber oriented parallel to the tank frame axis and having an outer surface consisting of a secondary mat layer of chopped fiberglass roving;

placing additional similarly-attached parallel widths of said secondary dry unidirected longo ply fabric upon said secondary two-ply liner laminate structure;

impregnating with a liquid thermosetting polymeric resin matrix a warp of a secondary unidirected circ ply fabric comprising continuous strands of glass fiber and having a leading edge;

attaching said leading edge of said warp of said resin-wet secondary unidirected circ ply fabric to one of said widths of said secondary dry unidirected longo ply fabric bonded to said first secondary hemispherical composite laminate tank end so that an edge of said warp of said resin-wet secondary unidirected circ ply fabric overlaps, by approximately 9 inches, the edge extremity of said first secondary hemispherical composite laminate tank end;

making a single circumferentially-oriented wrap of said warp of said resin-wet secondary unidirected circ ply fabric upon said secondary dry unidirected longo ply fabric to provide a portion of a first secondary shell-to-head anchor ring;

helically winding a first edge-abutting sequence of said resin-wet secondary unidirected circ ply fabric to press upon and impregnate said secondary dry unidirected longo ply fabric from said first secondary hemispherical composite laminate tank end to said second secondary hemispherical composite laminate tank end;

winding two circumferential wraps of said resin-wet secondary unidirected circ ply fabric upon said secondary dry unidirected longo ply fabric and said secondary sequence of parallel widths of dry fiberglass cloth overlapping by approximately 9 inches the edge extremity of said second secondary hemispherical composite laminate head end to provide a second secondary shell-to-head anchor ring;

helically winding, from said perimeter edge of said second secondary hemispherical composite laminate tank end to said perimeter edge of said first secondary hemispherical composite laminate tank end, a second edge-abutting sequence of said resin-wet secondary unidirected circ ply fabric;

making a single circumferentially oriented wrap of said warp of said resin-wet secondary unidirected circ ply fabric to complete the first secondary shell-to-head anchor ring;

wrapping a single secondary cover ply of a dry tightly woven 6 ounce per square yard fiberglass cloth upon said just-wound matrix-impregnated secondary unidirected circ ply fabric, all of said resin-impregnated outer tank laminate plies applied to said axle-supported primary tank forming a secondary cylindrical composite laminate tank shell structure having an exterior surface, said secondary hemispherical composite laminate tank ends forming a secondary tank;

painting said exterior surface of said secondary cylindrical composite laminate tank shell structure and said secondary hemispherical composite tank ends with an opaque thermosetting cover ply resin;

curing the secondary laminate matrix and cover ply resins forming said secondary cylindrical composite laminate tank shell structure;

cutting tank outlet holes through primary and secondary cylindrical composite laminate structures where each of said tank outlet fitting plates is located;

bolting metal compression plates to each of said tank outlet fitting plates;

placing a three-ply laminate to overlap and cover the edges of each of said bolted metal compression plates to seal all of said outlet fittings;

installing a lift lug in a central one of said outlet fittings, such that a completed double wall tank structure defining a primary and a secondary container is formed on said motorized tank frame turning unit;

lifting and removing said completed double wall tank structure from said motorized tank frame turning unit;

laminating a composite seal to cover said primary and secondary axle access openings in the primary and secondary composite hemispherical ends; and leak testing said primary and secondary containers by simultaneously pressurizing both containers to 5 psi.

* * * * *